US010609977B1

(12) United States Patent
Stir

(10) Patent No.: US 10,609,977 B1
(45) Date of Patent: Apr. 7, 2020

(54) HEADWEAR WITH NECK COVER AND FACE COVER

(71) Applicant: Mark Stir, Freeport, FL (US)

(72) Inventor: Mark Stir, Freeport, FL (US)

( * ) Notice: Subject to any disclaimer, the term of this patent is extended or adjusted under 35 U.S.C. 154(b) by 112 days.

(21) Appl. No.: 16/107,802

(22) Filed: Aug. 21, 2018

(51) Int. Cl.

| | |
|---|---|
| ***A42B 1/20*** | (2006.01) |
| ***A42B 1/24*** | (2006.01) |
| ***A42B 1/18*** | (2006.01) |
| ***A42B 1/02*** | (2006.01) |

(52) U.S. Cl.
CPC ..... *A42B 1/206* (2013.01); *A42B 1/02* (2013.01); *A42B 1/18* (2013.01); *A42B 1/205* (2013.01); *A42B 1/24* (2013.01)

(58) Field of Classification Search
CPC ..... A42B 1/205; A42B 1/206
USPC ... 2/9, 172, 173, 175.6, 206, 209.11–209.13, 2/243.1
See application file for complete search history.

(56) References Cited

U.S. PATENT DOCUMENTS

| | | | |
|---|---|---|---|
| 1,331,701 | A | 2/1920 | Fendelman |
| 1,481,541 | A | 1/1924 | Douglas |
| 2,462,258 | A | 2/1949 | Dannenberg |
| 2,897,510 | A | 8/1959 | Forbes-Robinson |
| 4,180,868 | A | 1/1980 | Snow |
| D363,812 | S | 11/1995 | Cassady |
| 5,875,493 | A | 3/1999 | MacDonald et al. |
| 7,240,372 | B2 | 7/2007 | Larson |
| 8,621,668 | B1 | 1/2014 | Nolz |
| D738,597 | S | 9/2015 | Matullo |
| D739,997 | S | 10/2015 | Dalrymple et al. |
| 9,439,466 | B2 | 9/2016 | Woo |
| 2015/0089709 | A1 | 4/2015 | DuCasse |

*Primary Examiner* — Katherine M Moran
(74) *Attorney, Agent, or Firm* — Peter Loffler

(57) ABSTRACT

A hat, such as a cap or a visor, has a typical neck cover and an onboard face cover that at least partially covers a user's face. The face cover is positionable between a deployed position wherein the face cover covers the user's face and the neck cover covers the user's neck area and a stowed position wherein the inner surface of the face cover is positioned against the inner surface of the neck cover. The face cover is held in the stowed position by either cooperating snaps or sections of hook and loop material located on the inner surface of each component with the respective units matingly engaged with one another.

11 Claims, 5 Drawing Sheets

HEADWEAR WITH NECK COVER AND FACE COVER

BACKGROUND OF THE INVENTION

1. Field of the Invention

The present invention relates to an item of headwear, such as a cap or a visor, wherein the item of headwear has a neck cover and a face cover that is stowed against and attached to the neck cover when use of the face cover is not desired.

2. Background of the Prior Art

Many hats—the term herein includes hats proper such as baseball or similar caps with or without a bill (beanies, skull caps, etc.), as well as visors—use neck covers that protect a user's neck area from sun and debris. The neck cover extends downwardly from the lower edge of the crown of the hat and is attached to approximately 180 degrees of the lower edge, more or less, of the crown typically covering the user from ear to ear. Neck covers typically terminate proximate the user's shoulders so as to completely cover the back of the neck when the user is wearing a typical shirt such as a t-shirt. The neck cover is made from a flexible material such as cotton, polyester, etc., and hangs loose from its section of attachment to the crown.

In addition to the neck cover, many people also wear a face cover to protect their face from the various items such as cold, wind, pests, such as mosquitoes, the sun, etc. Some people don a separate face cover, such as a balaclava type of covering to provide the desired protection; however, this solution tends to be restrictive and can be quite uncomfortable, especially in hot climates. Additionally, such a face cover interferes with the comfortable wearing of sunglasses or other types of eyewear. To address this, many hats come with an onboard face cover that the user places across their face when needed. The problem with current face cover systems is that when the face cover is not needed and thus not being worn, the face cover is stowed by either being bunched up and placed within the interior portion of the crown of the hat, making wearing of the hat somewhat uncomfortable, or the face cover is stowed in a separate compartment designed for stowage, increasing the cost and complexity of the hat.

A hat that protects both the neck and face of a user is needed that overcomes the above stated drawbacks of current systems by providing a hat that has an onboard a neck cover and a face cover wherein the face cover is quickly and easily stowed when not in use without detracting from the comfort of the hat and is easily deployed when use is desired. Such a hat should not be unduly complex or expensive.

SUMMARY OF THE INVENTION

The headwear with neck cover and face cover of the present invention addresses the aforementioned needs in the art by providing a hat (cap, visor, either with or without a front bill, etc.) wherein the hat has a typical neck cover depending downwardly from the lower edge of the crown of the hat and also has a face cover that is quickly and easily positionable between a deployed position and a stowed position wherein when the face cover is in the stowed position, the hat remains comfortable to wear. The headwear with neck cover and face cover is of relatively simple design and construction, being produced using standard manufacturing techniques, so as to make the headwear with neck cover and face cover relatively inexpensive to produce so as to be economically attractive to potential consumers for this type of device.

The headwear with neck cover and face cover of the present invention is comprised of a hat crown having a lower edge. A neck cover has a top edge, an opposing bottom edge joined by a first side edge and an opposing second side edge such that the neck cover, proximate the top edge thereof, is attached to the hat crown proximate the lower edge thereof. The neck cover also has a first inner surface and a first outer surface. A face cover has a third side edge attached to the first side edge of the neck cover and a fourth side edge attached to the second side edge of the neck cover, either fixedly or removably. The face cover also has a second inner surface and a second outer surface such that the face cover is positionable between a stowed position wherein the second inner surface of the face cover is positioned against the first inner surface of the neck cover and a deployed position wherein the second inner surface of the face cover is separated from the first inner surface of the neck cover. Attachment means are provided to retain the face cover in the stowed position with the second inner surface of the face cover attached to the first inner surface of the neck cover. The attachment means comprises either a first snap component that is located on the first inner surface of the neck cover and a second snap component that is located on the second inner surface of the face cover such that the second snap component matingly engages (snaps to) with the first snap component or a first section of cooperating hook and loop material located on the first inner surface of the neck cover and a second section of cooperating hook and loop material located on the second inner surface of the face cover such that the second section of cooperating hook and loop material matingly engages with the first section of cooperating hook and loop material. The item of head wear is dome shaped (typical cap or beanie) or may be truncated dome shaped (such as a visor). If the face cover proximate the fourth side edge thereof is removably attached to the neck cover proximate the second side edge thereof. a first snap component located on the first outer surface of the neck cover proximate the second edge thereof and a second snap component located on the second inner surface of the face cover proximate the fourth side edge thereof such that the second snap component matingly engages with the first snap component. The face cover may have a nose opening that is vented.

BRIEF DESCRIPTION OF THE DRAWINGS

Similar reference numerals refer to similar parts throughout the several views of the drawings.

DESCRIPTION OF THE PREFERRED EMBODIMENT

Figure 1:
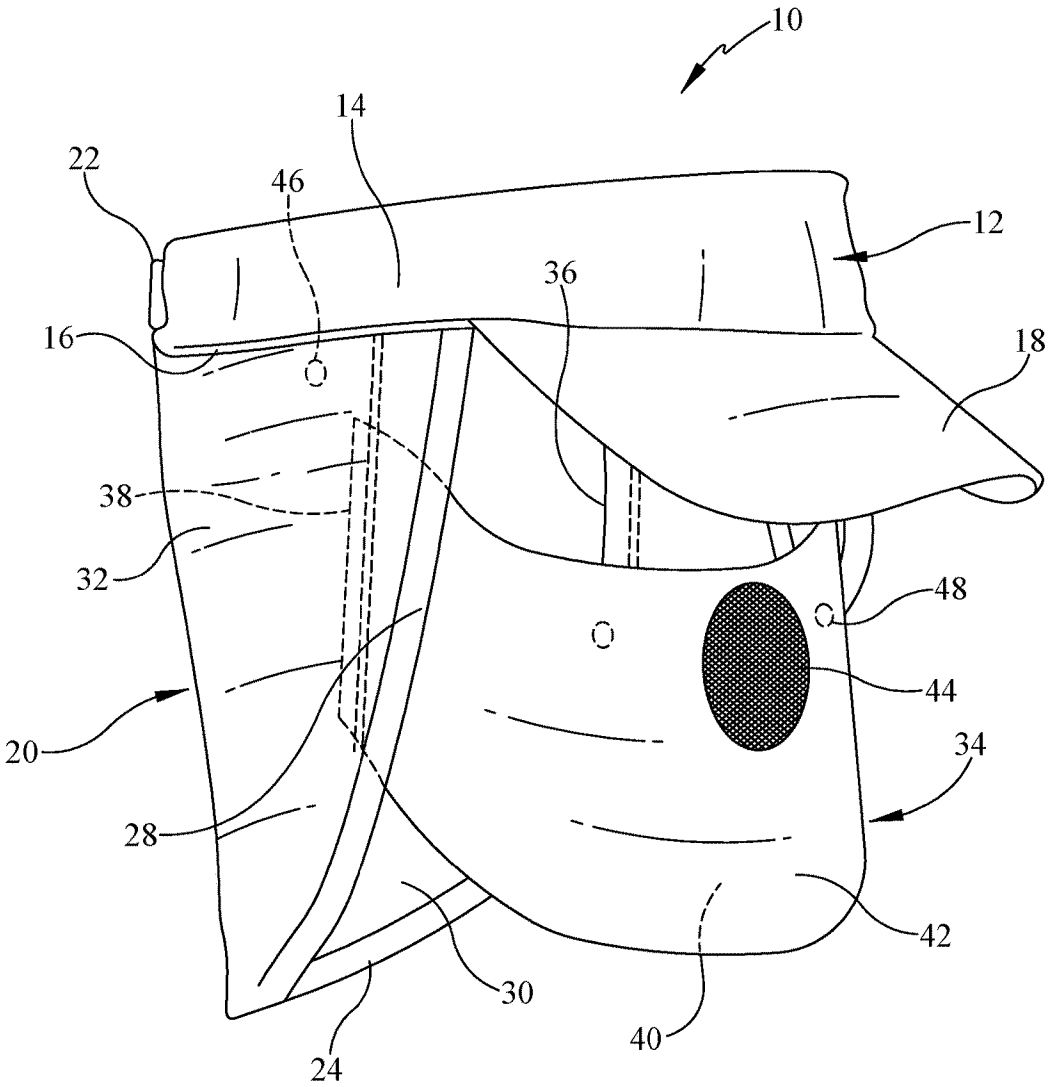
FIG. 1 is perspective view of the headwear with neck cover and face cover of the present invention with the face cover in a deployed position.
Figure 2:
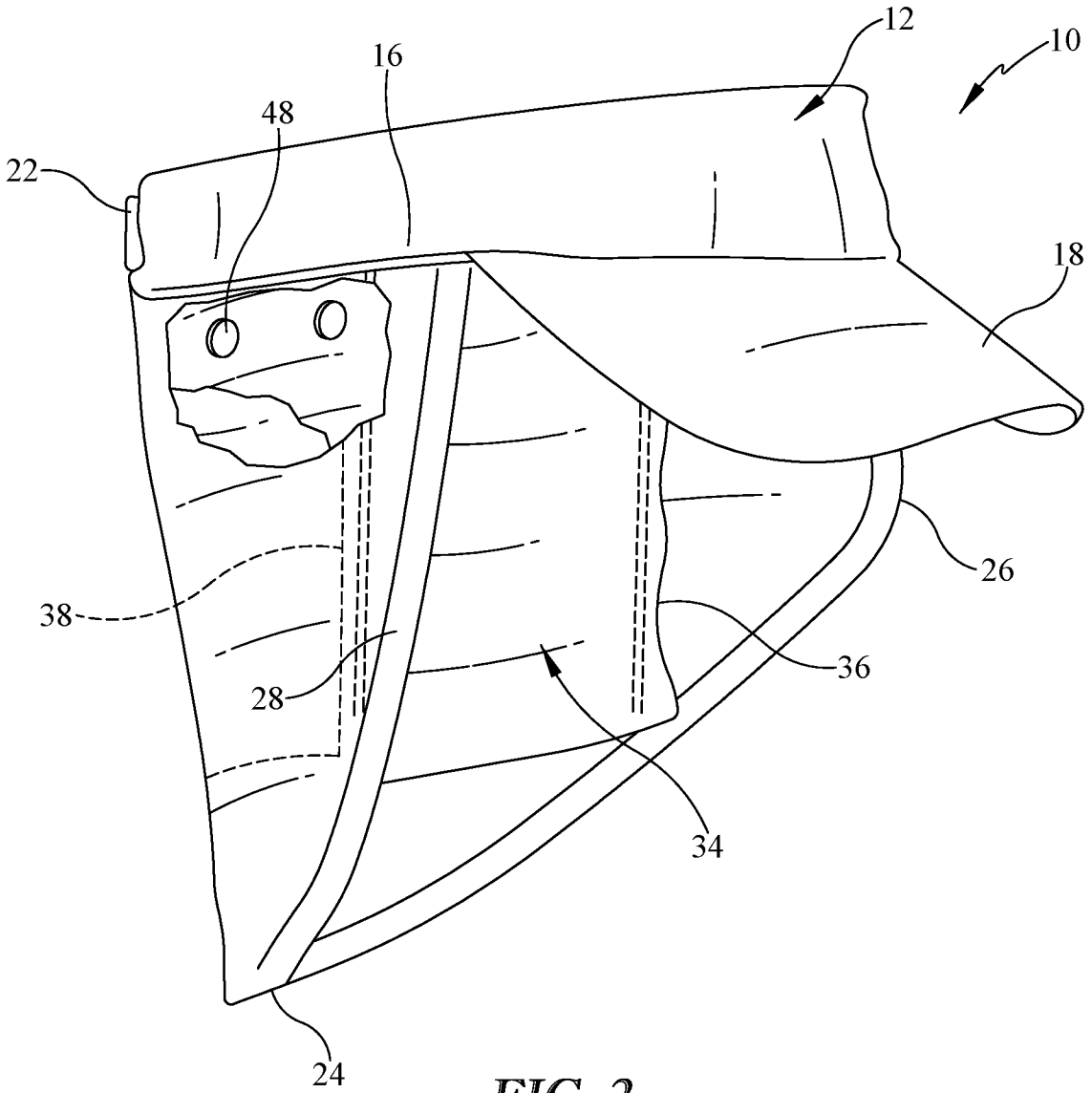
FIG. 2 is a perspective view, partially cut away, of the headwear with neck cover and face cover with the face cover in a stowed position.

Referring now to the drawings, it is seen that the headwear with neck cover and face cover of the present invention, generally denoted by reference numeral 10, is comprised of a hat crown 12, that may be truncated at the top as illustrated (again, the term hat includes caps, such as baseball caps, the illustrated visor type of hat, beanies, etc.), with a crown body 14 and a lower edge 16. The hat crown 12 may have a bill 18 extending therefrom as is known in the art. A neck cover 20 has a top edge 22 and an opposing bottom edge 24, joined by a first side edge 26 and an opposing second side edge 28. The neck cover 20 also has a first inner surface 30 and a first outer surface 32. The neck cover 20 is made from an appropriate cloth or similar material. The top edge 22 of the neck cover 20 is attached to the crown body 14 proximate the lower edge 16 thereof in appropriate fashion such as via stitching, and partially encircles the crown body 14 and extends downwardly from the lower edge 16 of the hat crown 12 when the hat I properly worn.

A face cover 34, which may be made from the same or similar material used to make the neck cover 20, has a third side edge 36 and a fourth side edge 38 and has a second inner surface 40 and a second outer surface 42 such that the third side edge 36 of the face cover 34 is attached to the neck cover 20 proximate the first side edge 26 thereof in appropriate fashion such as via stitching (or can just be an extension thereof so that the neck cover 20 and the face cover 34 are unitary members). Additionally, the fourth side edge 38 of the face cover 34 is attached to the neck cover 20 proximate second side edge 28 thereof in appropriate fashion such as via stitching. The face cover 34 may have a nasal opening 44 which may be vented.

As seen, the face cover 34 is attachable to the neck cover 20 other than the respective edge connections described above such that the first inner surface 30 of the neck cover 20 faces and is adjacent to the second inner surface 40 of the face cover 34. The face cover 34 is retained in this position by providing one or more first snap components 46 (male or female) on the first inner surface 30 of the neck cover 20 and corresponding second snap components 48 (female or male) on the second inner surface 40 of the face cover 34.

In order to use the headwear with neck cover and face cover 10 of the present invention, if the user decides to use the headwear with neck cover and face cover 10 without deploying the face cover 34, the face cover 34 is positioned against the neck cover 20 and each snap component 46 on the neck cover 20 is mated with a corresponding second snap component 48 on the face cover 34 so that the face cover 34 is snapped into a stowed position against the neck cover 20. The headwear with neck cover and face cover 10 is worn as a typical hat with a depending neck cover 20 with the back of the user's head positioned against the second outer surface 42 of the face cover 34. If use of the face cover 34 is desired, the face cover 34 is unsnapped from the neck cover 20 and the headwear with neck cover and face cover 10 is passed over the top of a user's head so that the face cover 34 is positioned against the user's face and the neck cover 20 covers the user's neck area, with the second inner surface 40 of the face cover 34 facing the user's face. When use of the face cover 34 is no longer desired, the headwear with neck cover and face cover 10 is removed, the face cover 34 is once again snapped to the neck cover 20 and the headwear with neck cover and face cover 10 is donned.

Figure 3:
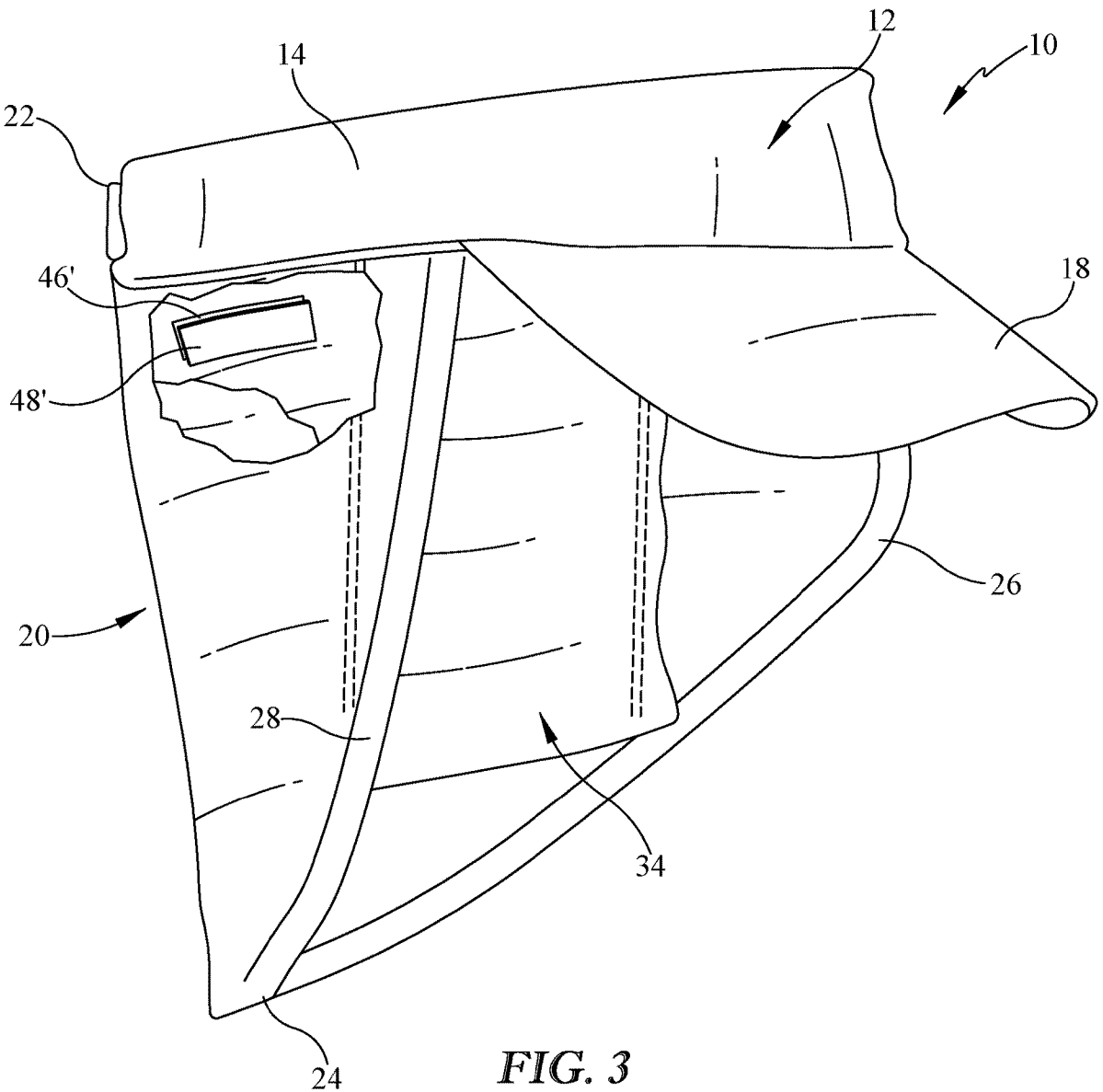
FIG. 3 is a perspective view, partially cut away, of the headwear with neck cover and face cover with the face cover in a stowed position using an alternate attachment system.
Figure 4:
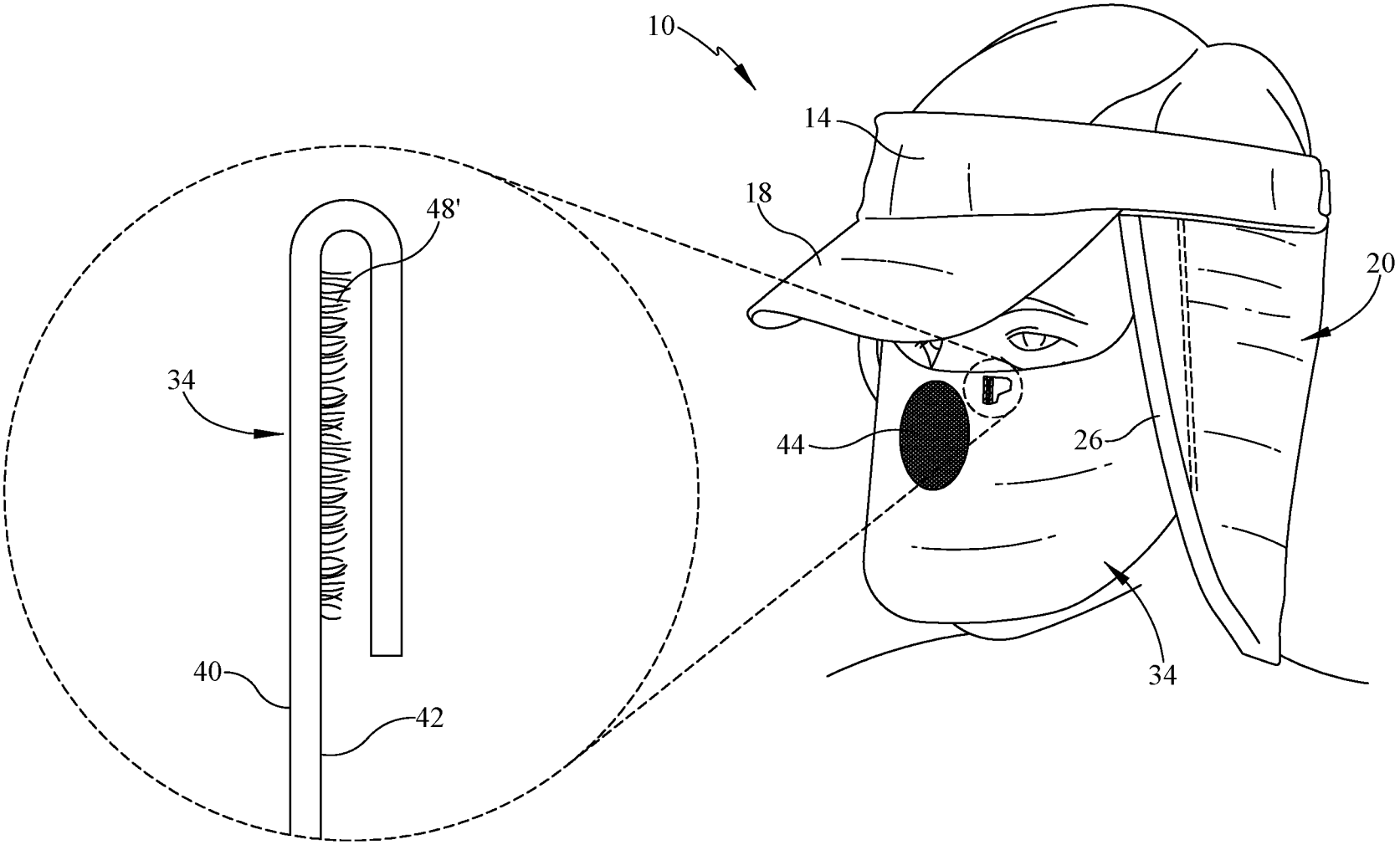
FIG. 4 is a perspective view, partially cut away, with a close up detail view thereof, of the headwear with neck cover and face cover of FIG. 3.

As seen in FIGS. 3 and 4, an alternate attachment method can be used to attach the face cover 34 to the neck cover 20 by providing a first section of cooperating hook and loop material 46' on the first inner surface 30 of the neck cover 20 and corresponding second cooperating hook and loop material 48' on the second inner surface 40 of the face cover 34. If use of the face cover 34 is desired, the face cover 34 is detached from the neck cover 20 and the headwear with neck cover and face cover 10 is passed over the top of a user's head so that the face cover 34 is positioned against the user's face and the neck cover 20 covers the user's neck area. When use of the face cover 34 is no longer desired, the headwear with neck cover and face cover 10 is removed, the face cover 34 is once again attached to the neck cover 20 via the cooperating hook and loop material 46' and 48' and the headwear with neck cover and face cover 10 is donned. As seen in FIG. 4, the second section of cooperating hook and loop material 48' is located a sufficient distance below the top edge (not separately numbered) of the face cover 34 to that a portion of the face cover 34 can be folded over and cover the second section of cooperating material 48' so that this second section of cooperating hook and loop material 48' does not directly rub against the face of the user.

Figure 5:
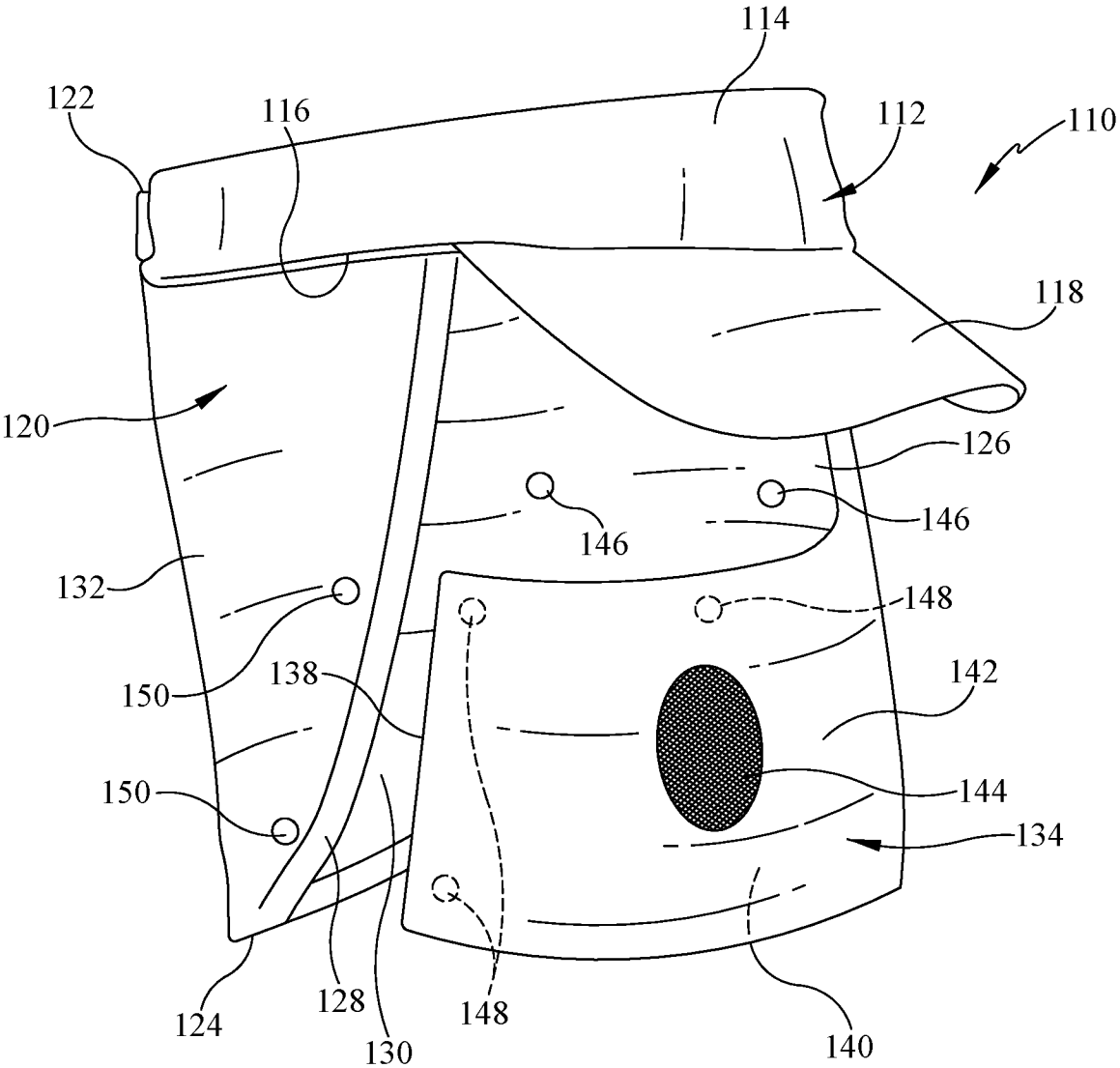
FIG. 5 is an alternate embodiment of the headwear with neck cover and face cover of the present invention.

As seen in FIG. 5, an alternate embodiment of the headwear with neck cover and face cover of the present invention, generally denoted by reference numeral 110, is comprised of a hat crown 112, that may be truncated at the top as illustrated (again, the term hat includes caps, such as baseball caps, the illustrated visor type of hat, etc.), with a crown body 114 and a lower edge 116. The hat crown 112 may have a bill 118 extending therefrom as is known in the art. A neck cover 120 has a top edge 122 and an opposing bottom edge 124, joined by a first side edge 126 and an opposing second side edge 128. The neck cover 120 also has a first inner surface 130 and a first outer surface 132. The top edge 122 of the neck cover 120, the neck cover 120 being made from an appropriate cloth or similar material, is attached to the crown body 114 proximate the lower edge 116 thereof in appropriate fashion such as via stitching, and partially encircles the crown body 114 and extends downwardly from the lower edge 116 of the hat crown 112.

A face cover 134 extends from the first side edge 126 of the neck cover 120 (the neck cover 120 and the face cover 134 may be integral, indeed monolithic units or may be attached to one another at the neck cover's second side edge 128 (or proximate thereof) in similar fashion described above) and has a fourth side edge 138 and also has a second inner surface 140 and a second outer surface 142. The face cover 134 may have a nasal opening 144 which may be vented.

As seen, the face cover 134 is attachable to the neck cover 120 other than the respective possible edge connection described above such that the first inner surface 130 of the neck cover 120 faces and is adjacent to the second inner surface 140 of the face cover 134. The face cover 134 is retained in this attached position by providing one or more first snap components 146 (male or female) on the first outer surface 132 of the neck cover 120 and corresponding second snap components 148 (female or male) on the second inner surface 140 of the face cover 134 and matingly snap to one another. Additionally, one or more third snap components 150 (male or female) is located on the first outer surface 132 of the neck cover 120 proximate the second side edge 128 thereof.

In order to use the headwear with neck cover and face cover 110 of the present invention, if the user decides to use the headwear with neck cover and face cover 110 without deploying the face cover 134, the face cover 134 is positioned against the neck cover 120 and each first snap component 146 on the neck cover 120 is mated with a corresponding second snap component 148 on the face cover 134 so that the face cover 134 is snapped into a stowed position. The headwear with neck cover and face cover 110 is worn as a typical hat with a neck cover 120 with the back of the user's head positioned against the second outer surface 142 of the face cover 134. If use of the face cover 134 is desired, the face cover 134 is unsnapped from the neck cover 120 and at least some of the second snap components 148 on the face cover 134 are mated with the corresponding third snap components 150 located on the first outer surface 132 of the neck cover 120 proximate the second side edge 128 so that the neck cover 120 covers the user's neck area and the face cover 134 covers the user's face, with the second inner surface 140 of the face cover 134 facing the user's face. When use of the face cover 134 is no longer desired, the face cover 134 is once again unsnapped from its attachment to the first outer surface 132 of the neck cover 120 and snapped to the first inner surface 130 of the neck cover 120 and the headwear with neck cover and face cover 110 is donned.

Of course, in this embodiment, cooperating hook and loop material can also be used, as described above, instead of the snaps.

While the invention has been particularly shown and described with reference to an embodiment thereof, it will be appreciated by those skilled in the art that various changes in form and detail may be made without departing from the spirit and scope of the invention.

I claim:

1. An item of head wear comprising:

a hat crown having a lower edge;

a neck cover having a top edge and an opposing bottom edge joined by a first side edge and an opposing second side edge, such that the neck cover, proximate the top edge thereof, is attached to the hat crown proximate the lower edge thereof, the neck cover also having a first inner surface and a first outer surface;

a face cover having a third side edge attached to the neck cover proximate the first side edge and a fourth side edge attached, to the neck cover proximate the second side edge, the face cover also having a second inner surface and a second outer surface such that the face cover is positionable between a stowed position wherein the second inner surface of the face cover is attached to the first inner surface of the neck cover and a deployed position wherein the second inner surface of the face cover is detached from the first inner surface of the neck cover; and attachment means to retain the face cover in the stowed position with the second inner surface of the face cover attached to the first inner surface of the neck cover.

2. The item of head wear as in claim 1 wherein the attachment means comprises:

a first snap component located on the first inner surface of the neck cover; and a second snap component located on the second inner surface of the face cover such that the second snap component matingly engages with the first snap component.

3. The item of head wear as in claim 1 wherein the attachment means comprises:

a first section of cooperating hook and loop material located on the first inner surface of the neck cover; and a second section of cooperating hook and loop material located on the second inner surface of the face cover such that the second of cooperating hook and loop material matingly engages with the first section of cooperating hook and loop material.

4. The item of head wear as in claim 1 wherein the attachment means comprises either a first snap component located on the first inner surface of the neck cover and a second snap component located on the second inner surface of the face cover such that the second snap component matingly engages with the first snap component or a first section of cooperating hook and loop material located on the first inner surface of the neck cover and a second section of cooperating hook and loop material located on the second inner surface of the face cover such that the second section of cooperating hook and loop material matingly engages with the first section of cooperating hook and loop material.

5. The item of head wear as in claim 1 wherein the item of head wear is dome shaped.

6. The item of head wear as in claim 1 wherein the item of head wear is truncated dome shaped.

7. The item of head wear as in claim 1 wherein the face cover proximate the fourth side edge thereof is removably attached to the neck cover proximate the second side edge thereof.

8. The item of head wear as in claim 1 wherein the face cover proximate the fourth side edge thereof is removably attached to the neck cover proximate the second side edge thereof by providing a first snap component located on the first outer surface of the neck cover proximate the second edge thereof and a second snap component located on the second inner surface of the face cover proximate the fourth side edge thereof such that the second snap component matingly engages with the first snap component.

9. The item of head wear as in claim 2 wherein the face cover proximate the fourth side edge thereof is removably attached to the neck cover proximate the second side edge thereof by providing a third snap component located on the first outer surface of the neck cover proximate the second edge thereof such that the second snap component located on the face cover matingly engages with the third snap component on the neck cover.

10. The item of head wear as in claim 1 wherein the face cover has a nose opening.

11. The item of head wear as in claim 1 wherein the face cover has a nose opening that is vented.

* * * * *